United States Patent [19]

Watanabe

[11] 4,240,632

[45] Dec. 23, 1980

[54] BASEBALL GAME

[75] Inventor: Hiroyuki Watanabe, Tokyo, Japan

[73] Assignee: Tomy Kogyo Co., Inc., Tokyo, Japan

[21] Appl. No.: 40,411

[22] Filed: May 18, 1979

[30] Foreign Application Priority Data

Jun. 12, 1978 [JP] Japan ..... 53-71156

[51] Int. Cl.[3] ..... A63F 7/00; A63F 9/22

[52] U.S. Cl. ..... 273/88; 273/93 R

[58] Field of Search ..... 273/88, 89, 85 R, 93 R

[56] References Cited

U.S. PATENT DOCUMENTS 2,883,193 4/1959 Iannone et al. ..... 273/88

2,925,275 2/1960 Schlapa ..... 273/88

*Primary Examiner*—George J. Marlo

*Attorney, Agent, or Firm*—Staas and Halsey

[57] ABSTRACT

A baseball game having a housing with a transparent face with a baseball diamond thereon, first, second and third mechanical mechanisms for respectively simulating the pitching of a baseball, the swinging of a bat, and an appropriate hitting/catching situation. Other person operated controls permit simulation of a pitched baseball in either strike or ball configuration, and energization of the spring motor contained within the housing. When a simulated hit is made, lights are energized from a built-in battery supply for indicating same. Scoring structures are provided for keeping track of the various situations as in a real game of baseball.

8 Claims, 19 Drawing Figures

BASEBALL GAME

BACKGROUND OF THE INVENTION

1. Field of the Invention

This invention relates generally to a baseball game of compact, portable size playable by two persons for amusement.

2. Summary of the Invention

A baseball game according to the invention includes a housing having a transparent face with a replica of a baseball diamond together with simulated players thereon. A first mechanical mechanism contained within the housing simulates the pitching of a baseball while a second mechanism simulates the swinging of a bat. A third mechanism is provided for indicating any one of a number of baseball hitting and catching situations. Two players of the game control the respective mechanisms by means of buttons extending externally of the housing.

An additional person operated control simulates the situations which normally can occur during a game of baseball of a pitched strike or ball.

Another external player operated structure permits energization of a spring motor within the housing for effecting the various simulated game functions.

Other scoring structures are provided for keeping count of the one, two, and three players on base, number of strikes, balls and outs of the player at bat, and the individual team scores for each inning of the game indicated as home and visitors. Normally nine innings are played just like in a regular game of baseball.

When a simulated hit of the ball is made by the batter, a fiberglass optic member is illuminated as well as an indicator of the end results of the hit for viewing by the persons playing the game.

An object of this invention is to provide a baseball game which will simulate the action of a real game as closely as possible.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
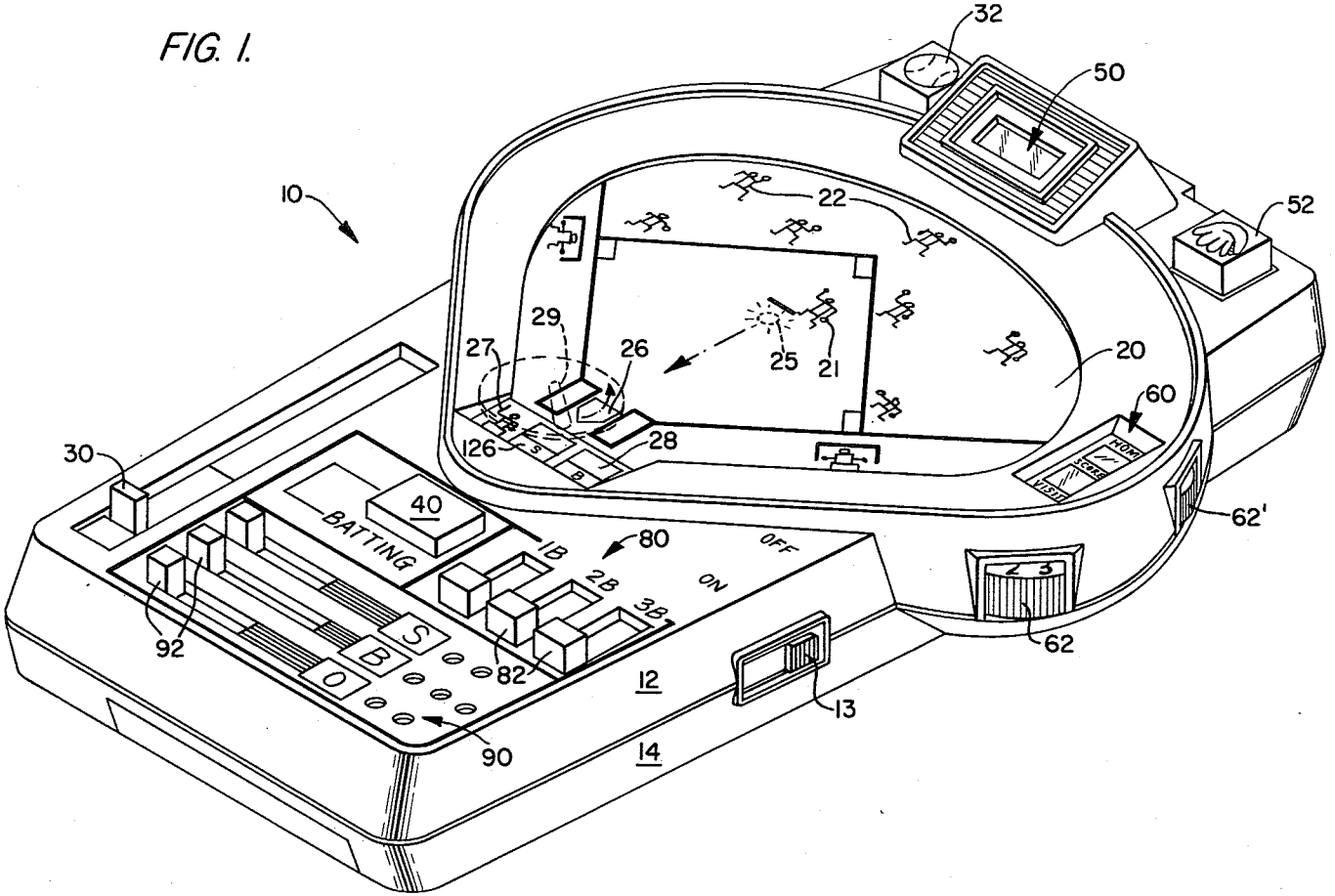
FIG. 1 is a perspective view of the baseball game of this invention.

Referring to the drawings, the baseball game as illustrated in FIG. 1 comprises a hollow housing made of an upper half 12, and a lower half 14. The mechanical mechanisms for the game are contained within the housing, while various apertures in the upper half 12 permit control actuators to extend externally of the game. An on-off button 13 operates an internal switch to connect the self-contained battery source to the electrical components of the game. A lever 30 is used to energize a spring within the housing for effecting later operation of the internal mechanisms.

A transparent plate 20 has a replica of a baseball diamond thereon. Also a stick figure of a ball pitcher 21, as well as outfielders and the like 22, are depicted on this plate.

When playing the game, after energization of the internal spring by moving lever 30 from the position shown in FIG. 1 towards the ball diamond, the person representing the outfield team can push button 32 to simulate the pitching of a baseball. This baseball pitching is indicated by a light 25 which moves toward home plate 26 and the batter 27 therebeside. When the simulated ball 25 passes by the home plate 26 and into area 126 it indicates a strike, while an off center area 28 indicates a Ball. A simulated bat structure 29 is swung or rotated when the batting button 40 is appropriately depressed.

If the timing of the bat swing by the person representing the batting team is correct so as to hit the ball 25, then a simulated hit structure will be lighted within the housing which shows up as a curved bar of light through the transparent cover plate.

Simultaneously therewith a baseball hit and catching situation indicator is energized which may be viewed through window 50. After a hit is made the outfield person can depress catching button 52 which will effect stopping of the ball situation indicator to represent an out, a hit, two or three base hit, or a homerun.

As each person representing a team goes through an inning, the score made may be indicated on scorekeeping indicators 62 and 62' viewable through window 60.

During each series of plays for each inning, the knobs of indicator portion 80 may be appropriately moved to indicate players on first base, second base, and third base. These controls when actuated effect an appropriate showing of the players of the team at bat on the respective bases through the transparent cover plate. Also for the team at bat, the strikes and balls for each individual player may be indicated at 90, as well as the number of outs for the side at bat.

Figure 2:
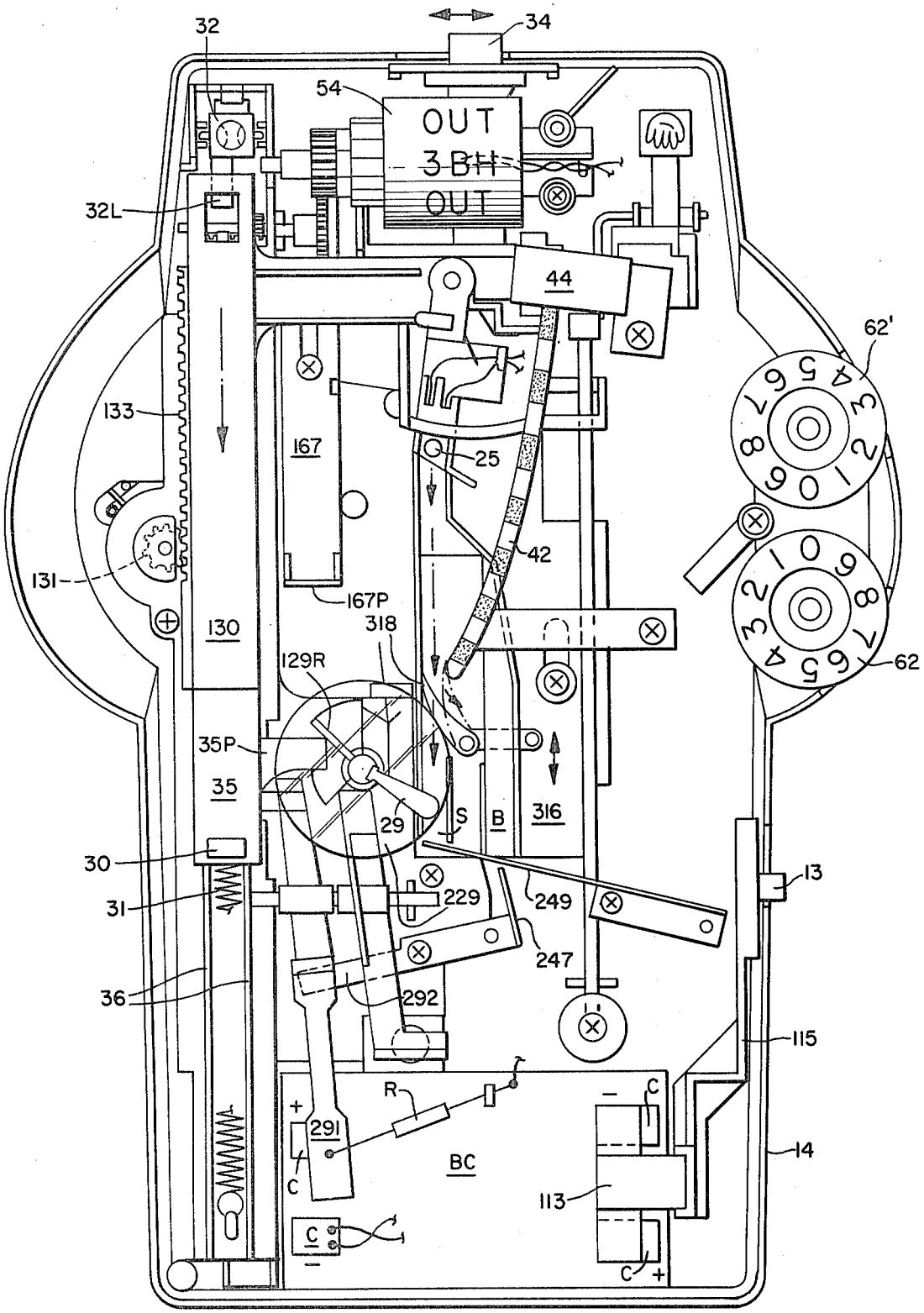
FIG. 2 is a top plan view with the upper half of the game housing removed for showing the internal operating mechanisms.

Looking at FIG. 2, the arrangement of the mechanical mechanisms inside the housing may be clearly seen. The energization lever 30 is connected to a slidable cocking plate 35 which slides on the upper surface of rails 36. Also slidable upon these rails is the pitching simulation member 130. A spring 31 is connected at one end to the housing frame and at the other end to the under side of member 130. Member 130 is provided with rack teeth 133 which in turn engage with pinion 131.

Figure 11:
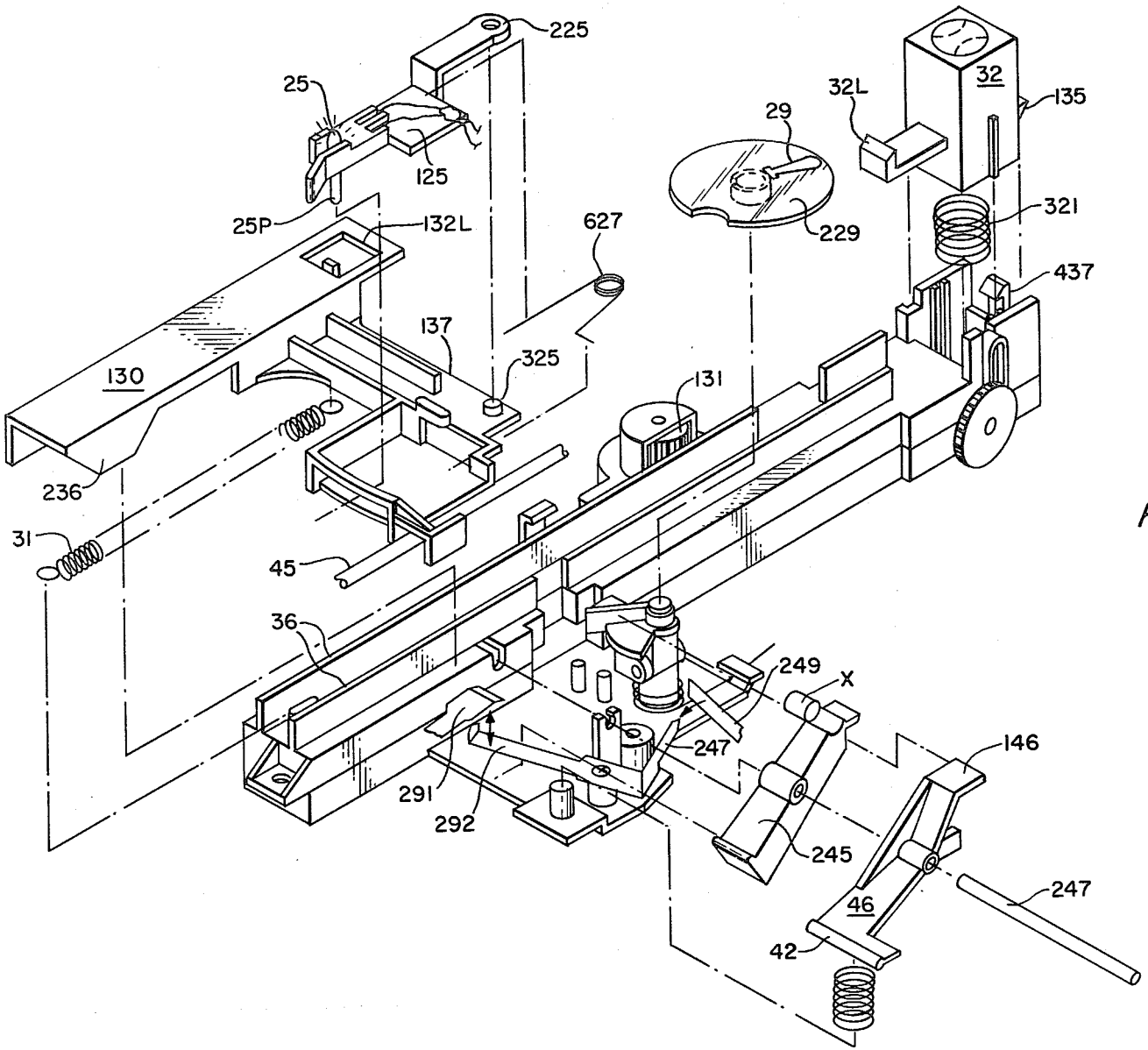
FIG. 11 is an exploded perspective of the simulated ball pitching and batting mechanisms.

FIG. 11 shows the member 130 slidable on rails 36, the baseball pitch button 32 and latch 32L. When the spring 31 is fully energized by movement of lever 30 toward the pitch button 32, latch 32L will snap under and engage with the aperture 132L for retaining the member 130 in the energized and cocked position. A spring 321 normally maintains this latching position, and limit members 135, 437 prevent the button 32 and latch 32L from moving above a given position.

Figure 7:
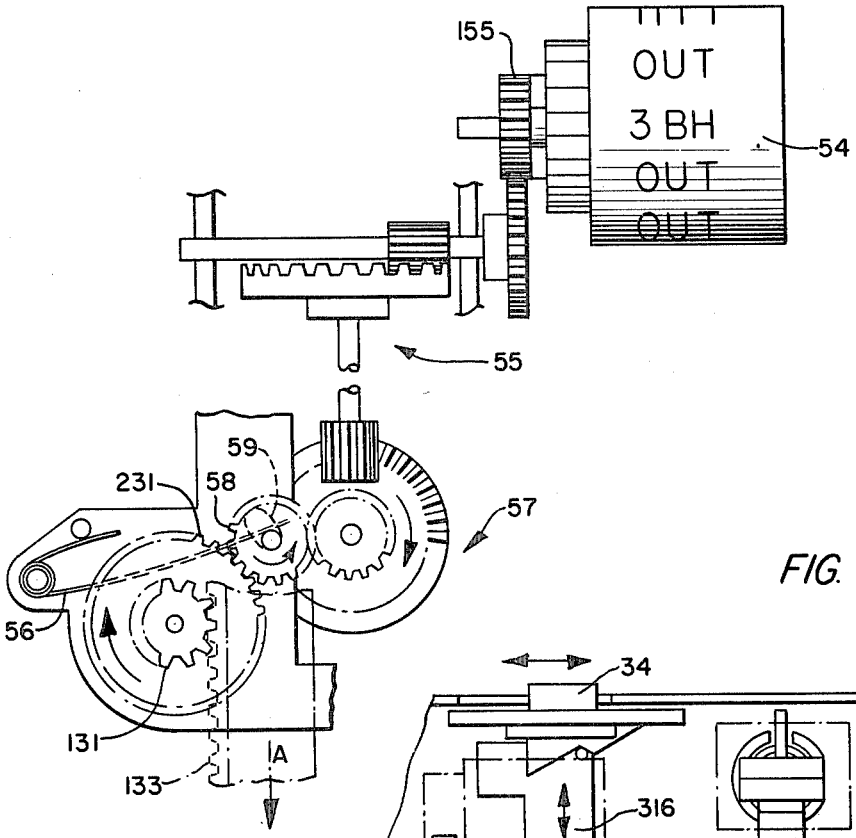
FIG. 7 is a view of the operating mechanism for the indicator of various baseball hit and catching situations.

Once member 130 has been energized and latched, then when it is desired to simulate the pitching of a ball, the person representing the field team, presses button 32 to release latch 32L from aperture 132L to permit the member 130 under the tension of spring 31 to move toward the batting end of the game. As this movement occurs, rack 133 causes rotation of pinion 131 and gear 231 affixed thereto, which as best seen in FIG. 7, effects rotation of pinion 58, integral gear and pinion 57, and transfer gears 55 to in turn cause rotation of drive pinion 155 integrally connected to a hit and catching situation indicator 54. A spring 56 normally maintains pinion 58 in driving engagement with gear 231 and the pinion/-gear 57 when the rack 133 is moving in the direction indicated by arrow A. However, when the spring 31 is being energized by moving rack 133 in the opposite direction to that shown, then the reverse rotation of pinion 131 will take place to cause the pinion 58 to function as a one-way clutch. This function occurs because of the slanted axle guides 59, which when pinion 58 is reverse rotated causes it to move against spring 59 to declutch the drive to pinion/gear 57. Thus, no drive will occur through the gears to the indicator 54 when the spring 31 is being energized by movement of lever 30, but will only rotate indicator 54 under the power of spring 31.

Figure 16:
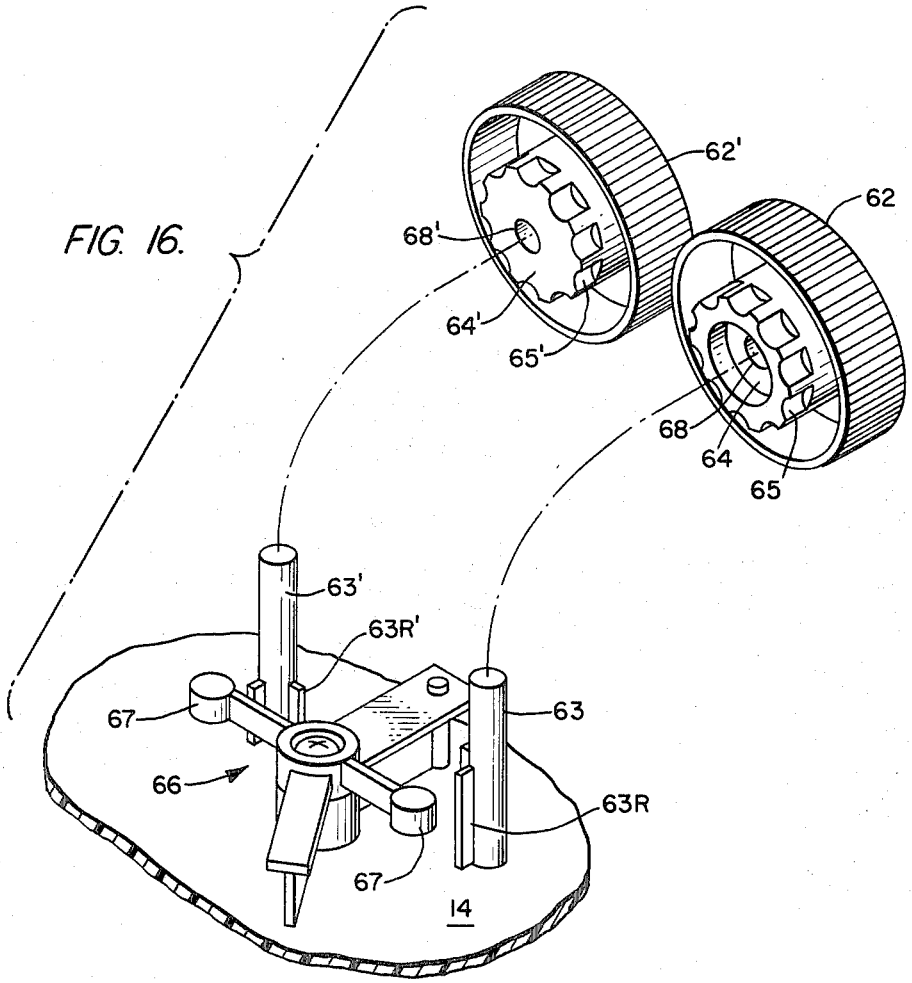
FIG. 16 is an exploded perspective of the team scoring indicators and resilient retention structure therefor.

Also in FIG. 2, the team scoring discs 62 and 62' with indicia from 0 to 9 can be seen. FIG. 16 shows the scoring disc structure in greater detail. The bottom housing has extending therefrom pins 63 and 63' with appropriate support ribs 63R and 63R' integral therewith. Also mounted upon a stud on the housing is a resilient retention structure 66. This structure has arms with circular members 67 at each end thereof. These members 67 will engage with the recesses 65 and 65' as provided on the inner portions of the scoring discs 62 and 62'. Appropriate apertures 68 and 68' fit over pins 63, 63', and the ribs 63R and 63R' support the discs at the proper position by engagement with portions 64, 64'.

Again, looking at FIG. 2, the switch button 13 is connected to an offset member 115 having a metal bridging contact 113 on the end thereof. The back side of the battery box BC is shown with external contacts C provided thereon. These contacts C are connected to the batteries inside the compartment in conventional fashion. When the switch 13 is turned to the on position, the metal contact portion 113 bridges the two contacts C on the right side of FIG. 1 to turn the device on. Appropriate wiring and conductors including a resistor R are connected to the other contacts. The wiring is connected to appropriate make and break switches, to be described below, and the simulated ball, simulated hit, and indicator lights.

Figure 6:
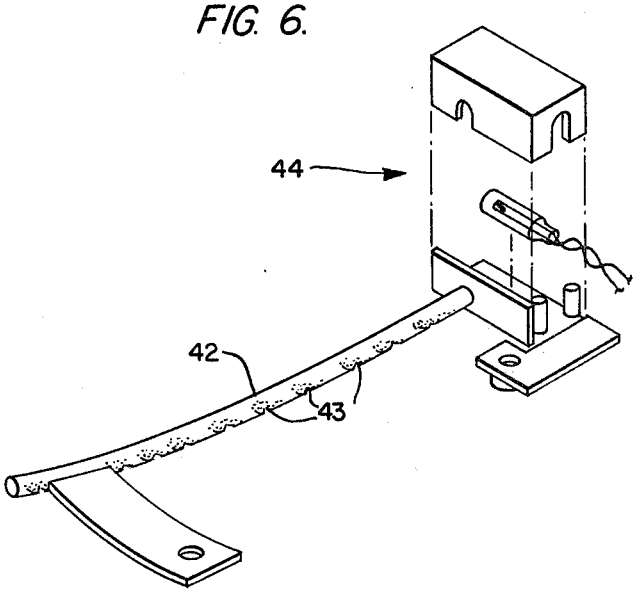
FIG. 6 shows an enlarged perspective view of the baseball hit simulating structure.

As shown in FIG. 6, the simulated hit indicator 42 consists of a curved rod of fiberglass having deformations 43 provided therealong for changing the dispersement of the light rays in order to simulate movement. A light housing 44 receives one end of the rod 42 and contains a small light, which when the appropriate contacts for scoring a hit are engaged, will be lit. This in turn lights up rod 42 to give the appearance of a baseball hit through the transparent plate 20. Simultaneously with the lighting up of a baseball hit, the light 75 mounted within indicator 54, see FIG. 9, will also be lit to appropriately show whatever hitting and catching situation occurs.

Figure 9:
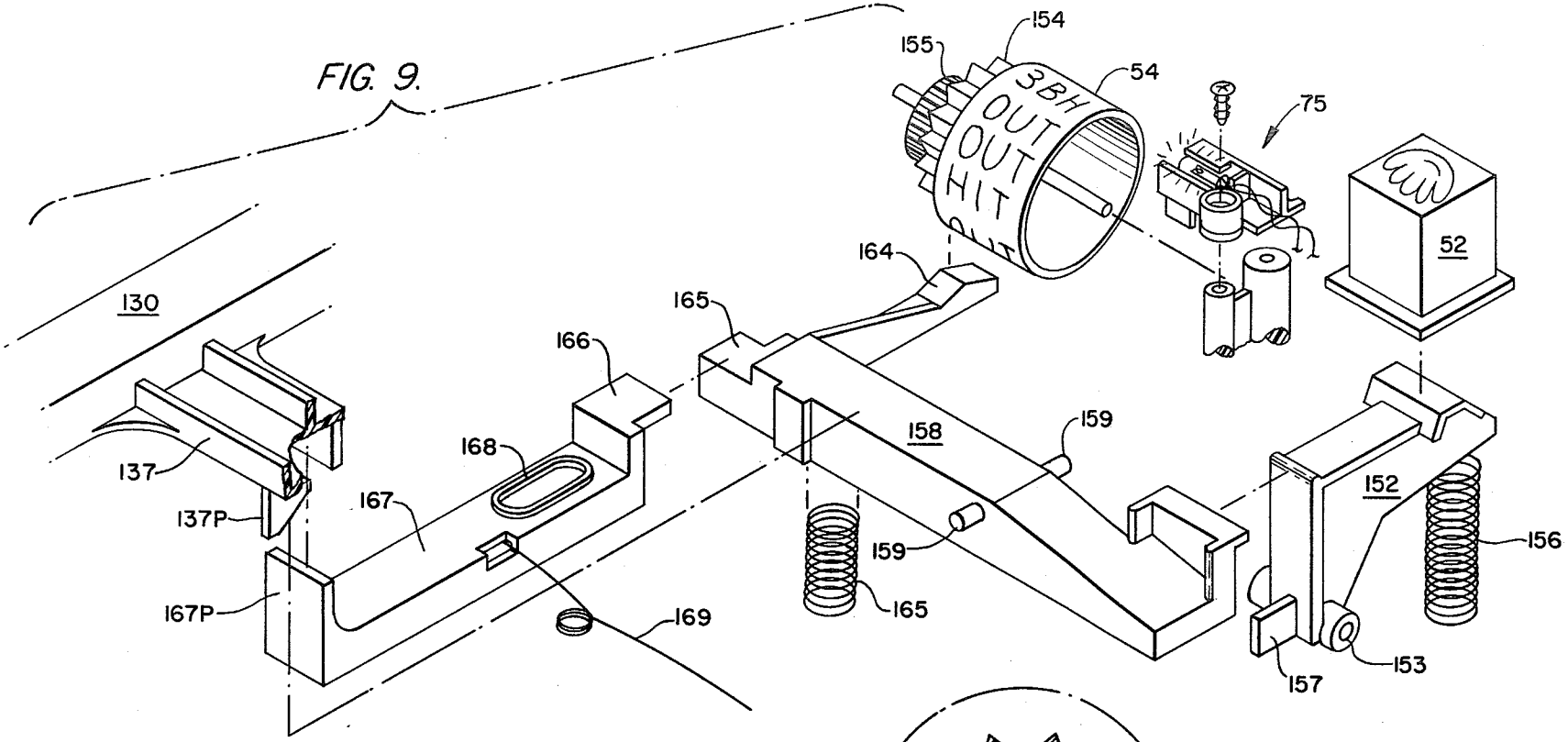
FIG. 9 is an exploded perspective of the baseball hit and catching situations indicator with stopping mechanism.
Figure 10:
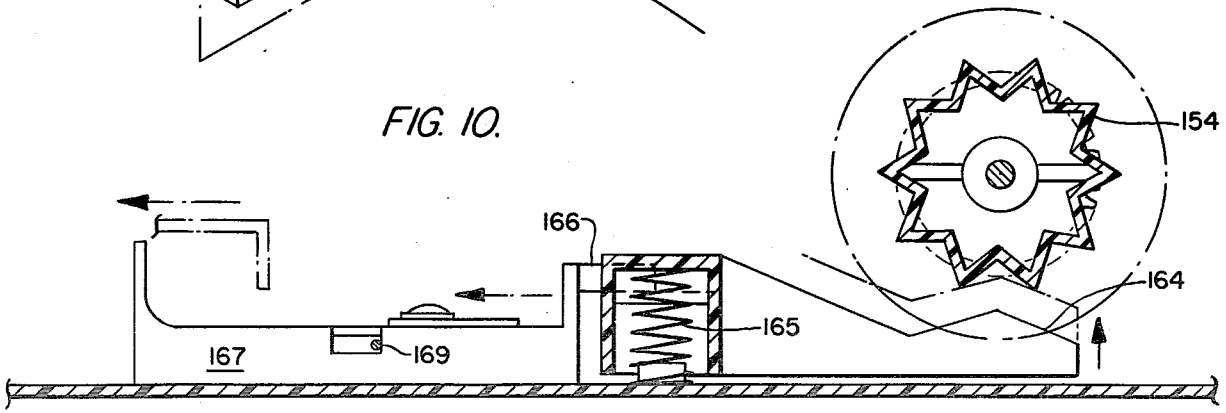
FIG. 10 is a side elevation of part of the structure of FIG. 9.

FIG. 9 also shows the structure for permitting the outfield person to simulate a catching situation after a ball has been hit. An arm 137 extending perpendicular to member 130 is the support for the simulated pitched baseball. Below arm 137 is an extending projection 137P which engages with projection 167P on one end of slidable member 167. Spring 169 normally biases slide member 167 towards the indicator 54. When in this biased position, extending portion 166 overlaps recessed portion 165 of pivot member 158. Member 158 is pivoted on pivots 159 and is biased upwardly by spring 165 which in turn causes ramp arm 164 to engage with the teeth 154 of indicator 54 to appropriately stop same. The catching simulation button 52 when depressed will effect rotation of member 152 clockwise around pivot 153 against the bias of spring 156. This in turn causes projection 157 to engage with the end of member 158 to effect the pivotable movement thereof to again stop indicator 54 through teeth 154 and ramp arm 164. However, as long as the member 167 is moved toward the indicator by spring 169 so that the projections 166 and 165 overlap, the stopping of the indicator is prevented. Thus, when the pitching slide member 130 is locked in energized position by latch 32L, it is impossible for the outfield person to stop rotation of indicator 54. However, once the button 32 is depressed and slide member 130 is moving toward the batter carrying the simulated pitched ball 25 theretowards, the catch button 52 becomes operative to stop rotating indicator 54.

Figure 8:
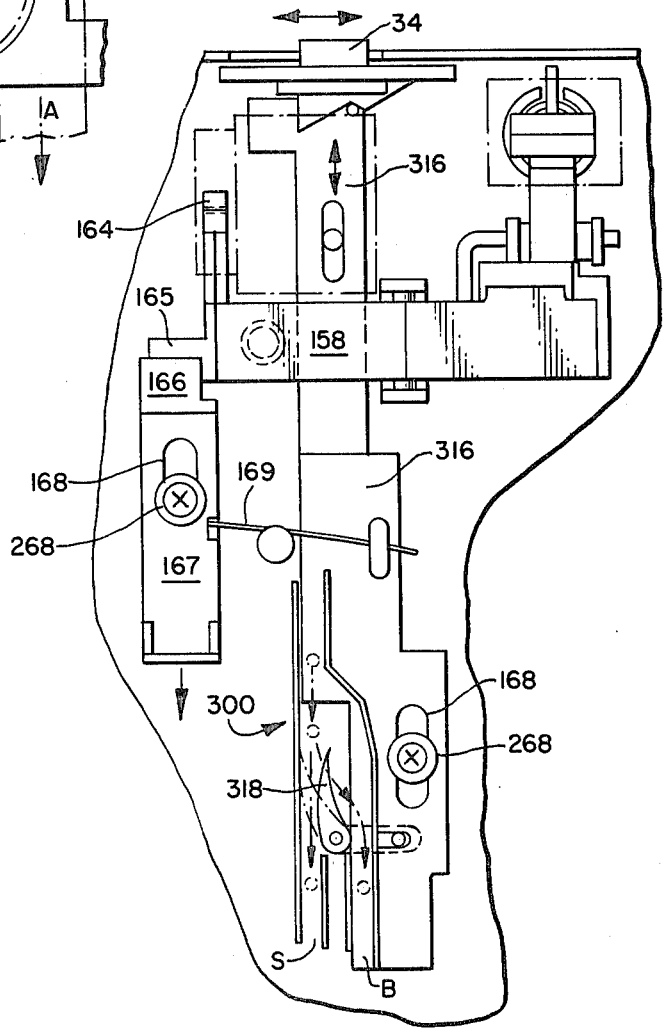
FIG. 8 is a fragmentary portion showing the strike/-ball pitched simulating mechanism.

Another feature of subject invention is the provision of simulated strikes and balls as thrown by the pitching outfield team. Button 34, as best seen in FIG. 8, controls slide member 316 to simulate the movement of ball light 25 in either a strike or ball path. When member 316 is slid toward the indicator, the teardrop-shaped member 318 is moved to the left which causes the simulated pitched ball (light 25, pin 25P) to move along and into the channel B (for a ball) of the guide structure 300. When button 34 is moved in the opposite direction, the slide 316 will move downwardly to cause teardrop member 318 to move to the right to allow pitched base ball light 25 to move in path S to simulate a strike situation. Appropriate screws with oversized washers 268 in conjunction with apertures 168 in the various sliding members retain some in proper position with the lower housing half 14.

In order to simulate a real baseball game, it is of utmost importance that the swing of the simulated bat 29, as provided on transparent disc 229, be interlocked with the simulated ball pitching and simulated hit mechanisms. This is accomplished by appropriate latch and timing structure between these mechanisms.

Figure 12:
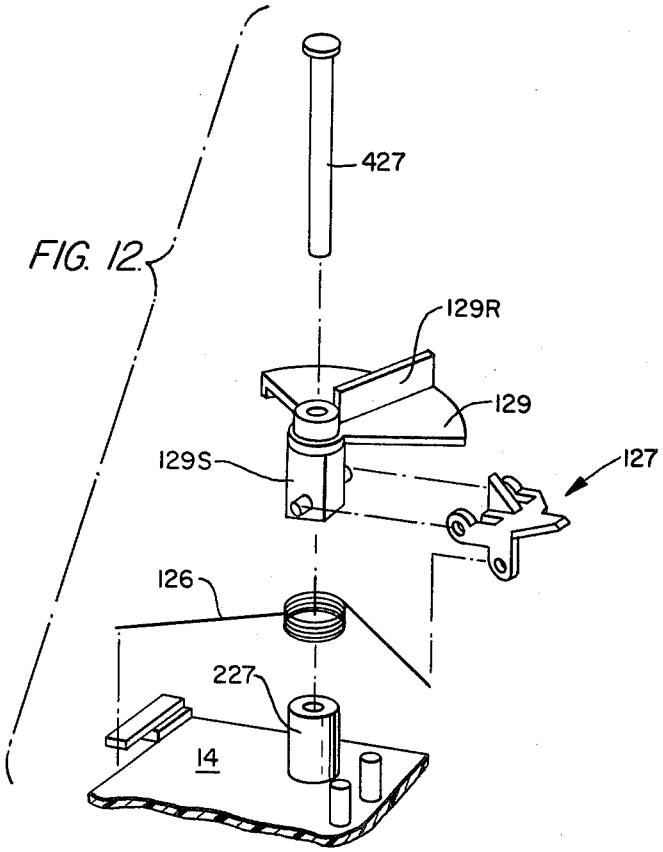
FIG. 12 is an exploded perspective of the simulated batting disc and latching timing support therefor.

FIG. 12 shows the support for the simulated bat structure which consists of an appropriate support pin 427 for holding the structure from a stud 227 mounted on the lower housing 14 and provided with a central bore therein. Rotatably mounted about pin 427 is a half disc 129 with a stud 129S and a rib 129R integral therewith. Pivoted latching structure 127 is also mounted from this rotatable structure. A bias spring 126 maintains half-disc 129 biased in the counterclockwise direction of FIG. 12.

Figure 3:
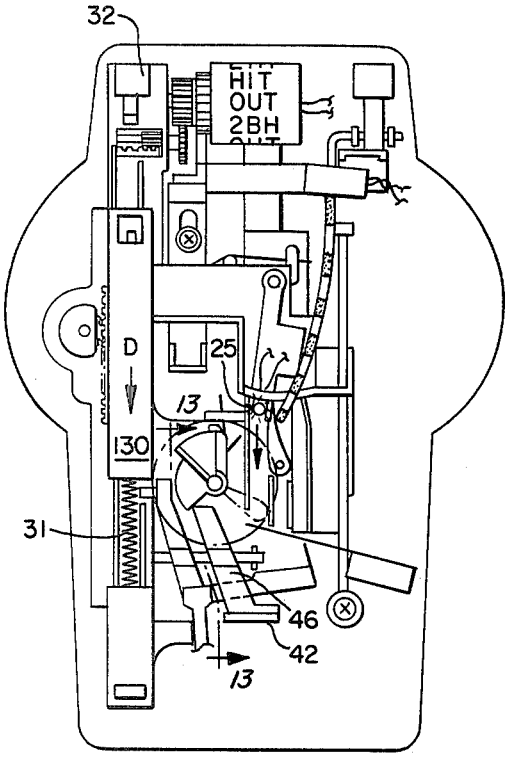
FIGS. 3, 4 and 5 show, in reduced size, the operating mechanisms of FIG. 2 in various stages of operation.
Figure 5:
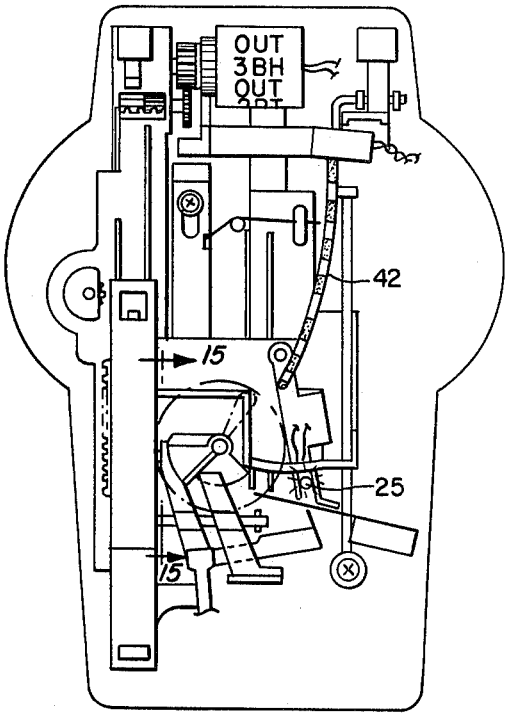
Figure 4:
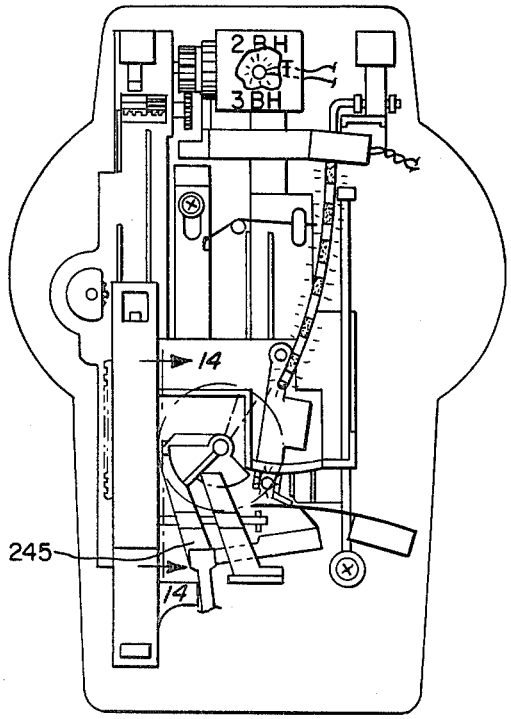
Figure 13:
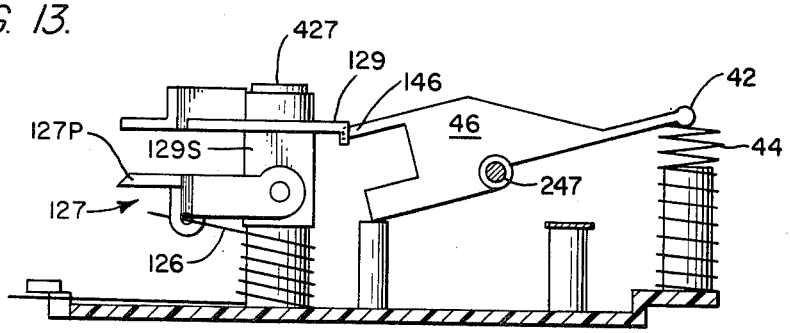
FIG. 13 is a side elevation taken along lines 13—13 of FIG. 3 depicting the operation of the structure of FIG. 12.
Figure 14:
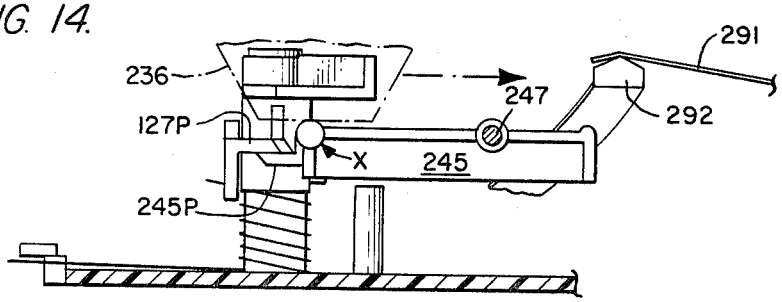
FIG. 14 is a side elevation taken along lines 14—14 of FIG. 4 of the batting and ball pitch timing interlock for simulating an actual hitting of the baseball by the batter.
Figure 15:
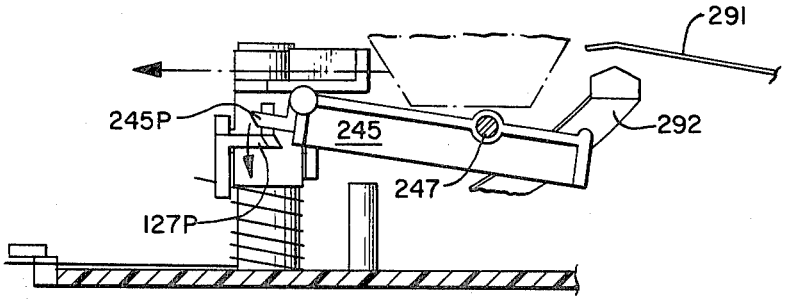
FIG. 15 is a side view of the structure of FIG. 14 showing another position thereof as taken along lines 15—15 of FIG. 5.

FIGS. 3, 4, and 5, in conjunction with FIGS. 13, 14, and 15 show the operation of the various mechanisms in conjunction with each other. As seen in FIG. 3, the pitching knob 32 has been depressed, thus releasing the pitch slide member 130 for movement in direction D which in turn moves the simulated ball light 25 towards the batter.

In FIG. 11, a guide rod 45 supports the outer end of arm 137 as the member 130, 137 moves toward the batter. The simulated ball light 25 is pivotally mounted by a support 125, pivot aperture 225, and pivot pin 325. A spring 627 normally maintains this pivot structure in the strike guide channel S of the strike/ball channel structure. A projecting pin 25P below the light engages with teardrop member 318 which will divert the light into the ball channel if the ball/strike control knob 34 has been so changed.

In FIGS. 2 and 3, the semi-disc 129 supporting the simulated bat disc 229 thereon, has been cocked by engagement with a projection 35P extending perpendicularly from cocking plate 35. After the bat 29 has been moved to the cocked position, it will appear as shown in FIGS. 2 and 3.

Now the player representing the batting team, by depressing batting knob 40 can release the latch structure for the simulated batting structure and allow same to pivot smartly counterclockwise around pin 627 by the force of spring 126.

FIG. 13 shows the structure as the pitch is first made, the semi-circle support disc 129 having been rotated against the bias of spring 126 to the latch position, and retained in this position by the projection 146 of lever 46. Lever 46 is pivotally mounted and is biased by spring 44 to the latching position. Button 40 is normally directly above portion 42 of lever 46 and when depressed, unlatches 146, 129 to simulate a swing of the bat. When this swing is made, stud 129S also rotates to move the pivotable interlock structure 127.

FIG. 14 along with FIG. 4 shows a simulated hit of the bat against the ball. When this occurs the contacts 291 and 292 are closed to represent a hit. For this to take place, the timing projection 236 extending from below member 130 must be over the X portion of pivot lever 245. Also, projection 127P of interlock latch 127 must overlap projection 245P of lever 245. If this occurs, then the correct timing of batting has taken place in correspondence with the pitched ball and it is proper for a hit to be made. Also the contacts 247 and 249, in FIG. 2, must be closed by slide 316 for the hit to be effected. This only occurs if the strike position of the strike/ball selector has been chosen by the outfield team person.

Assuming a simulated hit has been made, the light 44 and light bar 42 will be energized, and the indicator light 75 will be energized as the indicator 54 is being driven in fast rotation. Depending upon at what point the catching button 52 is depressed and the indicator 54 stopped, the indicator will indicate a particular hit/catch situation. Indicator 54 is viewable through viewing window 50 at the top of the game.

FIGS. 5 and 15 depict the mechanism when the batting timing does not properly mate with the pitch and therefore a hit could not be made. In this case, lever 245 is permitted to pivot about axis 247 because the projection 127P has not moved into position soon enough to latch projection 245P in order to prevent lever 245 from pivoting. Thus, in this case, contacts 291 and 292 are open, and thereby the simulated hit light, etc., cannot be energized. When slide member 130 is again moved to the top of the game, the projection 236 extending therebeneath will engage portion X to depress lever 245 to the normal position as in FIG. 14.

In summary, in order for a simulated hit to be shown through the transparent cover plate, the strike/ball switch 34 must be in the strike position, the depending ramp portion 236 of the pitching slide member must be over portion X of lever 245 at the same time that the batting button 40 is depressed. Assuming this occurs, then latch 127P of the batting structure will interlock with latch 245P of lever 245, and even though projection 236 of the pitching member has passed point X, the lever 245 will be prevented from pivoting, and thereby contacts 291 and 292 will remain closed. Thus, with all the contacts properly closed, the various indicating lights as already described will all be energized.

Figure 17:
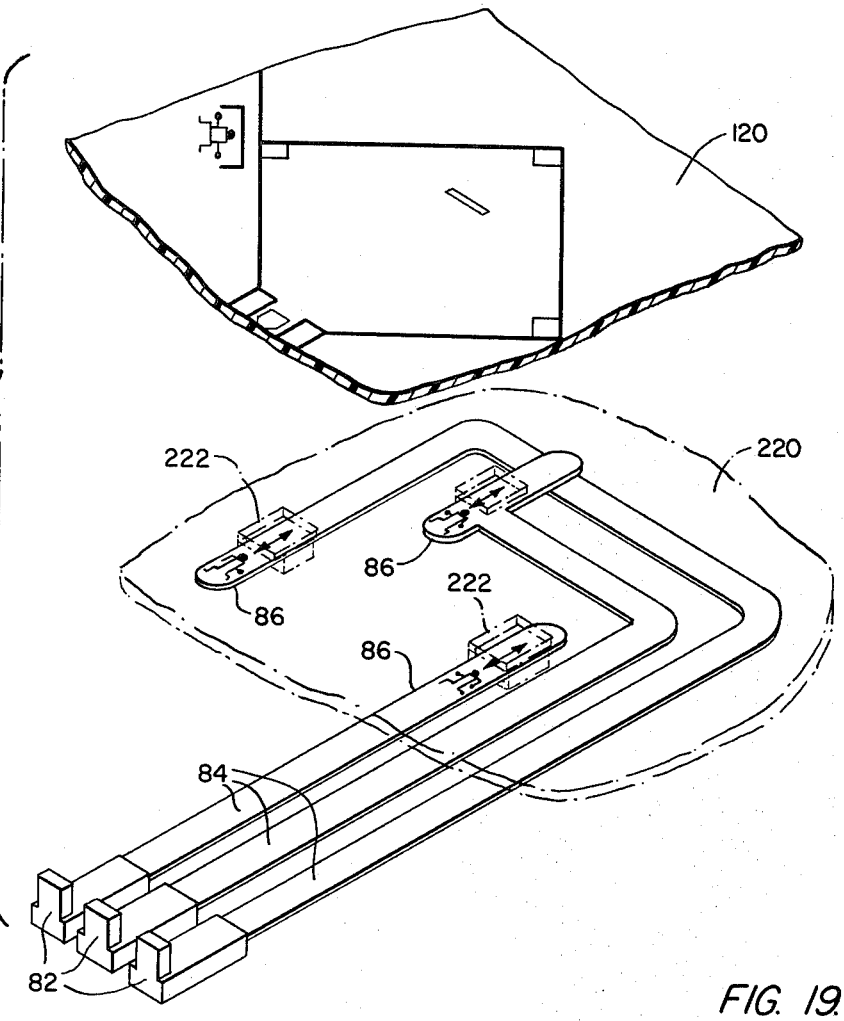
FIG. 17 is an exploded perspective of the player on base simulating structure.

FIG. 17 shows the structure for simulating the players on base according to the hit/catching situation indicator 54. The knobs 82 control slide elements 84 which are mounted slightly beneath a colored semi-transparent plate 220. Some of the outfielder stick figures 22, as shown in FIG. 1, may be provided on the top of colored plate 220 rather than on the outer transparent cover plate 120. Normally, the stick figures representing players on first, second and third base, as at 86 are hidden from view underneath colored plate 220. However, when a hit is made, and the indicator 54 indicates a base hit, then the appropriate control knob 82 representing such a hit will be moved upwardly toward the indicator to show a player on first base, second base, or third base. When this is done a stick figure will appear through an apertures 222 for the proper base.

Figure 18:
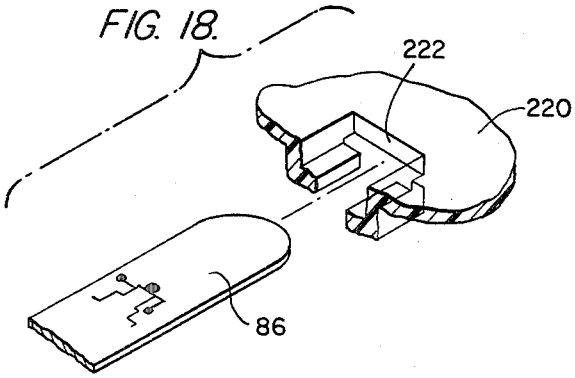
FIG. 18 is an enlarged view in perspective of a single player on base with viewing aperture therefor.

FIG. 18 shows an aperture 222 in enlarged form together with the stick figure on the end of slide member 86.

Figure 19:
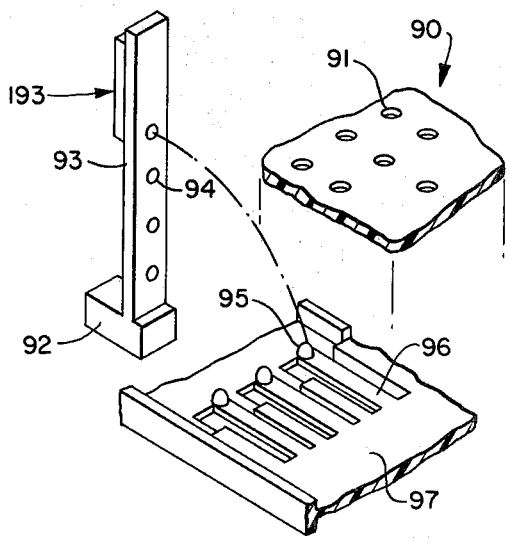
FIG. 19 is an enlarged perspective of the strike, ball and outs indicator structure of the game.

FIG. 19 shows the structure of the strike, balls, and outs indicator of reference numeral 90. The upper housing 12 has holes 91 provided therein in alignment with each of the respective indicators. Three slides, one for each of the respective indicatiors are provided. The knob 92 for each indicator 93 moves same in a substantially horizontal position as shown in FIG. 1. In FIG. 19 is shown the underside of an indicator with the depressions which mate with and complement semi-circular tips 95 on spring fingers 96 to function as resilient retention structure. Spring fingers 96 are part of a plate 97 which is attached to the underside of the upper housing 12. Preferably portions 193 with colors, such as red, green and yellow, are provided on indicators 93 to add attractiveness to the scoring and greater distinction therebetween.

As can be readily visualized, this baseball game device offers many of the features actually found in the real game of baseball, and quite closely simulates the actual game. Thus, for both teampersons, whether at bat or pitching, this game provides a lot of excitement and realism. Furthermore, the timing match requirement of a pitched ball and a swing of the bat, and the possibility of the ball being either a hitable ball, i.e., a strike, or a nonhitable one, i.e., ball, adds further realism to the game.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A baseball game comprising:

a housing having a transparent face with a replica of a baseball diamond thereon;

a first mechanism contained within said housing for simulating the pitching of a baseball;

a second mechanism contained within said housing for simulating the swinging of a bat;

a third mechanism contained within said housing for indicating any one of a number of baseball hitting and catching situations;

a person operated control for energizing a spring for effecting later operation of the aforesaid mechanisms;

an opponent operated control for initiating said ball pitching simulation first mechanism and another control for effecting stopping of said third mechanism; and a person operated control for the second mechanism for simulating the swinging of a bat.

2. The game of claim 1, together with further mechanism for simulating the pitching of a baseball in either a strike or ball configuration, said further mechanism including another externally operated person control.

3. The game of claim 1, wherein said first mechanism for simulating the pitching of a baseball comprises a slidable member movable along guide rails and latchable in an energized position; said spring connected to said slidable member at one end and affixed to the housing at the other end, a light structure pivotally mounted on said slidable member for movement therewith, and further mechanism associated with said pivotally mounted light for effecting the movement thereof in either a simulated baseball strike or baseball ball situation.

4. The game of claim 1, wherein said third mechanism for indicating any one of a number of baseball hitting and catching situations includes a gear driven indicator, a viewing window provided in said housing for viewing said indicator, connecting gear structure between said first mechanism and said indicator, and a control for effecting stopping of the indicator.

5. The game of claim 4, wherein said indicator further includes a light energizable when a simulated hit is made between the simulated baseball pitch and the simulated swinging of a bat when the timing of both agree as appropriate for making such a hit, and a simulated hit depicting fiberglass rod with light for energization simultaneously with the lighting of said indicator light.

6. The game of claim 5, together with players on base indicating structure for simulating players on the respective bases of said baseball diamond of the game.

7. The game of claim 6, together with a battery compartment and wiring for supplying electric power for the lights of the game, an on/off switch operable from externally of the housing for connecting said wiring with the battery supply, and contacts with the simulated hit, pitching and batting mechanisms for preventing light energization unless a simulated hit is made.

8. The game of claim 1, further including with the housing scorekeeping structure for keeping the score representative of a home team and a visitors team; further scoring structure for keeping track of strikes, balls, and outs for each inning; additional structure for indicating a man on first, second or third base; still further structure for indicating first and second strikes; still additional structure for incicating first, second, and third balls; and still further additional structure for indicating first and second outs.

* * * * *